US005299779A

United States Patent [19]

Collins

[11] Patent Number: 5,299,779

[45] Date of Patent: Apr. 5, 1994

[54] FLOOR COVERING INSTALLATION METHOD

[76] Inventor: Harvey C. Collins, 7143 S. River Rd., Marine City, Mich. 48039

[21] Appl. No.: 24,632

[22] Filed: Mar. 1, 1993

[51] Int. Cl.[5] ..... B66F 13/00

[52] U.S. Cl. ..... 254/1; 254/DIG. 4

[58] Field of Search ..... 254/DIG. 1, DIG. 4, 254/1, 2 R, 8 B, 8 C, 133 R, 134, 129, 131

[56] References Cited

U.S. PATENT DOCUMENTS

| | | | |
|---|---|---|---|
| 66,170 | 6/1867 | Patterson . | |
| 829,344 | 8/1906 | Larsen . | |
| 2,469,670 | 5/1949 | Thompson . | |
| 2,536,550 | 1/1951 | Hughes | 254/133 R |
| 2,786,649 | 3/1957 | Bottorff . | |
| 2,786,650 | 3/1957 | Bottorff . | |
| 2,910,270 | 10/1959 | Schultz . | |
| 3,081,066 | 3/1963 | Murawski . | |
| 3,426,752 | 2/1969 | Laico . | |
| 3,662,994 | 12/1970 | Johns . | |
| 4,194,726 | 3/1980 | Hance | 254/133 R |
| 4,712,771 | 12/1987 | Donnelly et al. | 254/131 |
| 4,846,443 | 7/1989 | Collins et al. | 254/133 R |
| 5,131,629 | 7/1992 | Hillhouse | 254/133 R |

*Primary Examiner*—Robert C. Watson

*Attorney, Agent, or Firm*—Harness, Dickey & Pierce

[57] ABSTRACT

A floor covering installation tool for raising and lowering furniture, partitions or the like has a frame, a raising and lowering mechanism and a lifting assembly. The frame or the lifting assembly has a portion which is positioned underneath the object to be lifted. The raising and lowering mechanism is actuated to raise or lower the object to be lifted. Upon raising the lifted object to a desired height, flooring or the like is positioned underneath the lifted object. After the flooring is positioned underneath the lifted object, the raising and lowering mechanism is activated to release the lifting mechanism and return it to its original position. Thus, the tool is ready to be reused to lift another desired object.

5 Claims, 3 Drawing Sheets

Fig-4
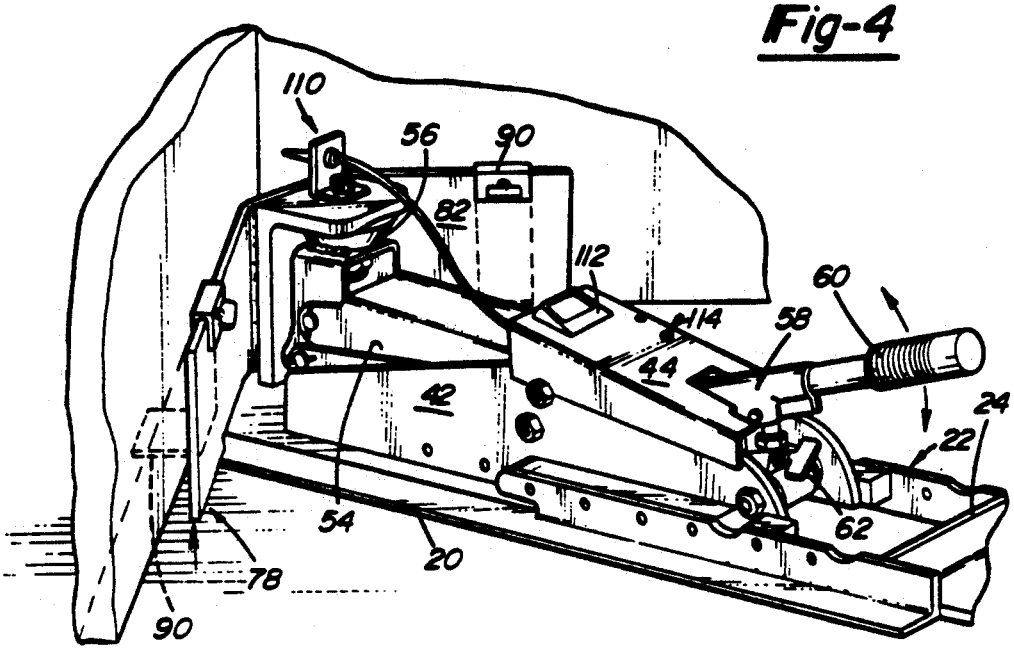
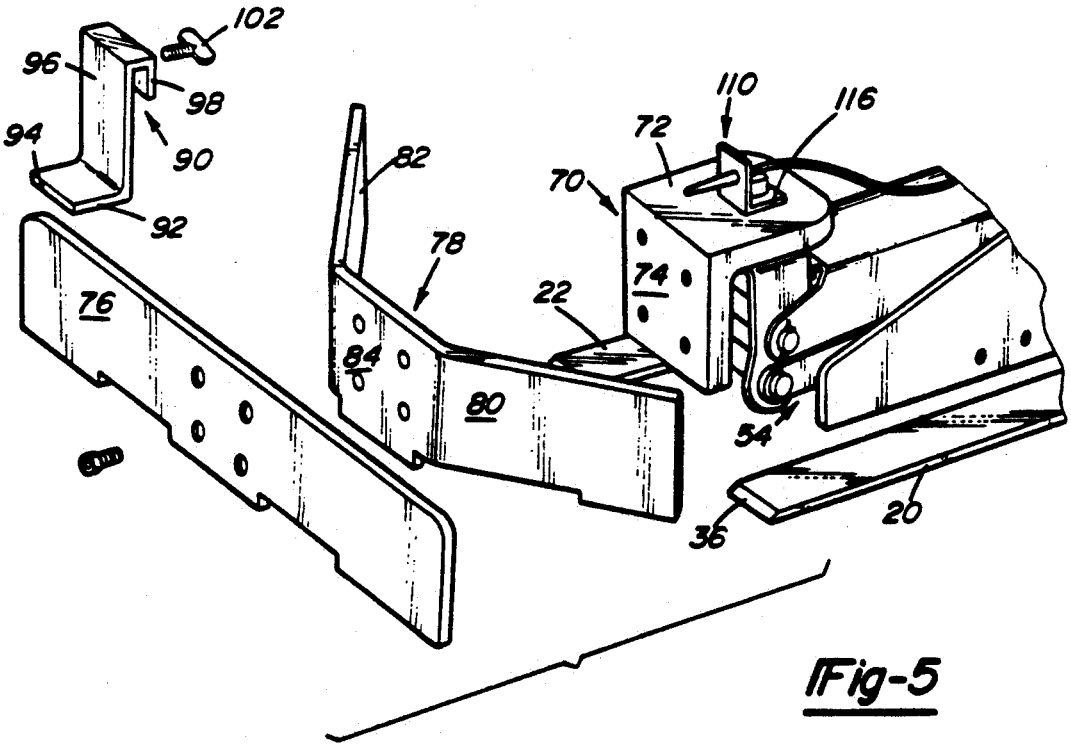
Fig-5

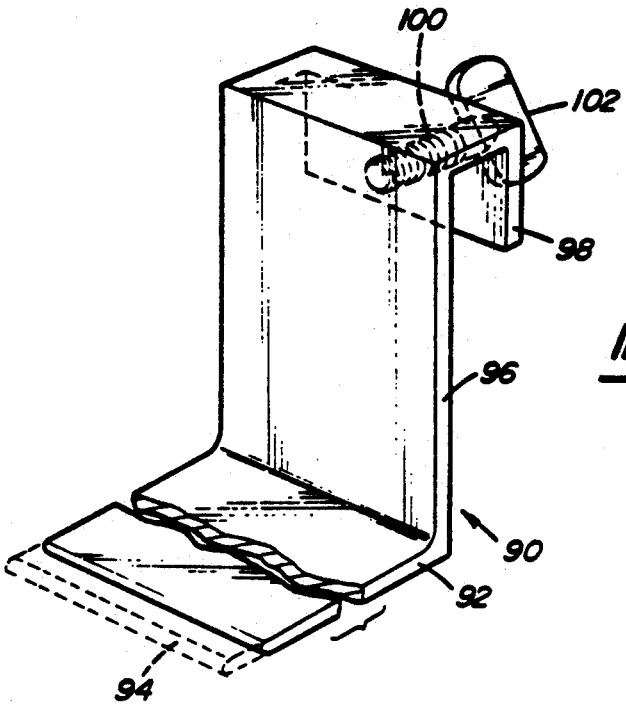
Fig-6
Fig-7
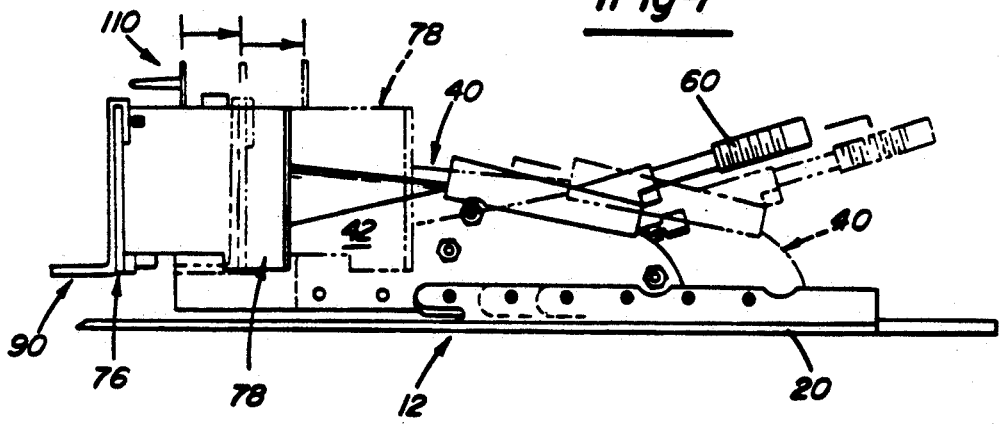
Fig-8
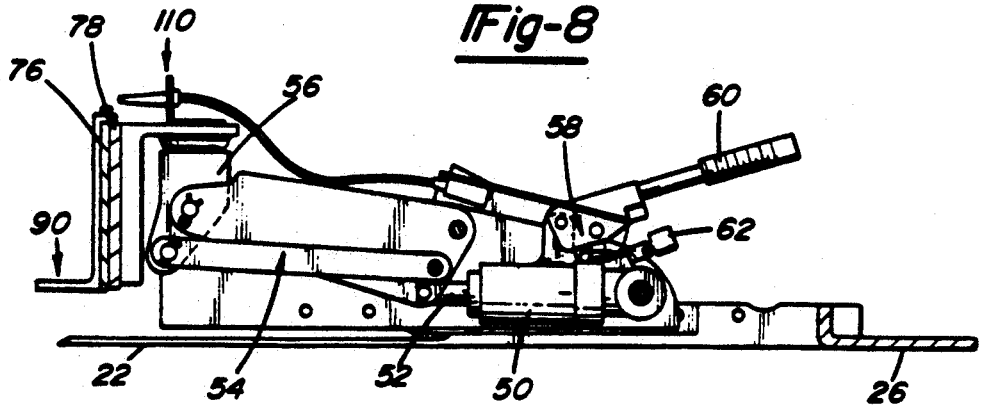

FLOOR COVERING INSTALLATION METHOD

BACKGROUND AND SUMMARY OF THE INVENTION

The present invention relates to installation of floor coverings and, more particularly, to a tool for raising and lifting furniture, partitions or like during the installation of the flooring.

During the installation of carpet, ceramic tile or the like in existing buildings where furniture, especially modular partitions, needs to be moved, the installer is faced with a recurring furniture moving dilemma. The installer may either move the furniture, partitions or the like by hand to one side of the room, install the carpet on that side of the room and move the furniture back onto the new flooring, install the remainder of the flooring and reposition the furniture. Another way is to raise the furniture, partitions or the like at its original position so that flooring may be positioned underneath the furniture, partition or the like.

A useful device for raising and lowering furniture, partitions or the like is illustrated in my U.S. Pat. No. 4,846,443, the specification and drawings of which are herein expressly incorporated by reference. This patent illustrates a lifting device for raising and lowering furniture, partitions or the like. While this invention provides the art with a satisfactory device for raising and lowering furniture, partitions or the like, designers continue to strive to improve the art.

Also, the following U.S. patents illustrate various types of lifting devices. The U.S. Pat. Nos. are:66,170; 829,344; 2,469,670; 2,536,550; 2,786,649; 2,786,650; 2,910,270; 3,081,066; 3,426,752; 3,662,994; 4,194,726.

The present invention provides the art with an improved floor covering installation tool which lifts partitions, furniture or the like. The present invention enables installers to position flooring underneath furniture, partitions or the like without necessitating removal of the furniture from its original position within the room receiving the floor covering.

The present invention also provides a removable abutment member which enables the device to lift partitions or the like with a single planar surface or with two or more planar surfaces, such as a corner of a partition. The invention is also provided with movable lifting brackets to enable multi-positioning of the brackets with respect to the object to be lifted and also to move from one abutment member to the next. The present invention also includes a live current indicator to test for live current in the object to be lifted.

From the subsequent description and the appended claims taken in conjunction with the accompanying drawings, other objects and advantages of the present invention will become apparent to those skilled in the art.

BRIEF DESCRIPTION OF THE DRAWINGS

FIG. 3 is a side elevational view of the tool of FIG. 1 lifting a partition or the like.

FIG. 4 is a rear perspective view of the tool of FIG. 1 lifting a partition at a corner.

FIG. 5 is an exploded perspective view of the lifting assembly in accordance with the present invention.

FIG. 6 is an enlarged perspective view of a lifting bracket in accordance with the present invention.

FIG. 7 is a side elevational view similar to that of FIG. 3 illustrating multiple positions of the raising and lifting mechanism on the frame.

FIG. 8 is a side elevational view partially in section of FIG. 2 through line 8—8 thereof.

DETAILED DESCRIPTION OF THE PREFERRED EMBODIMENT OF THE INVENTION

Figure 1:
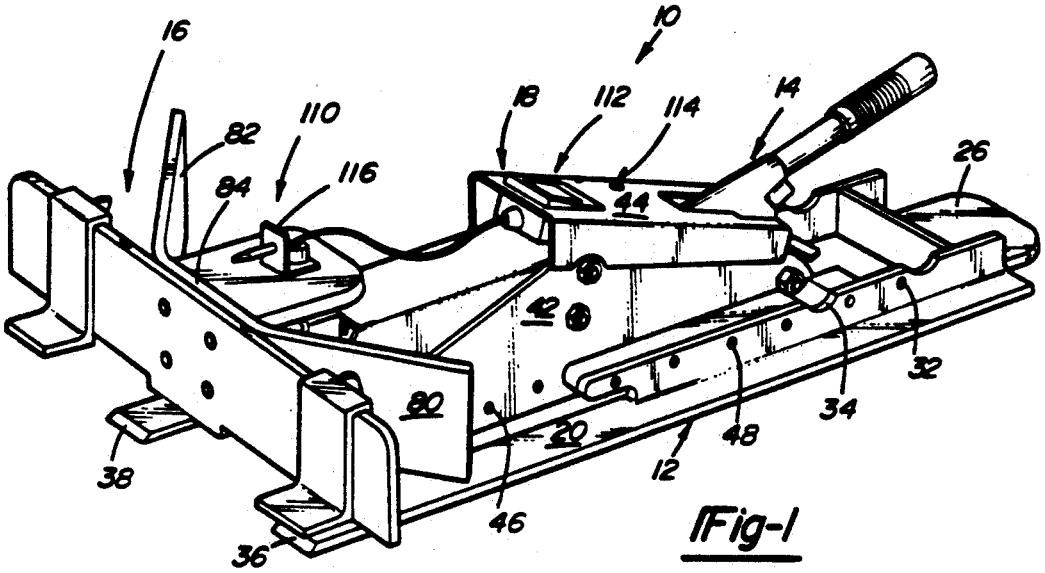
FIG. 1 is a front perspective view of an installation tool in accordance with the present invention.
Figure 2:
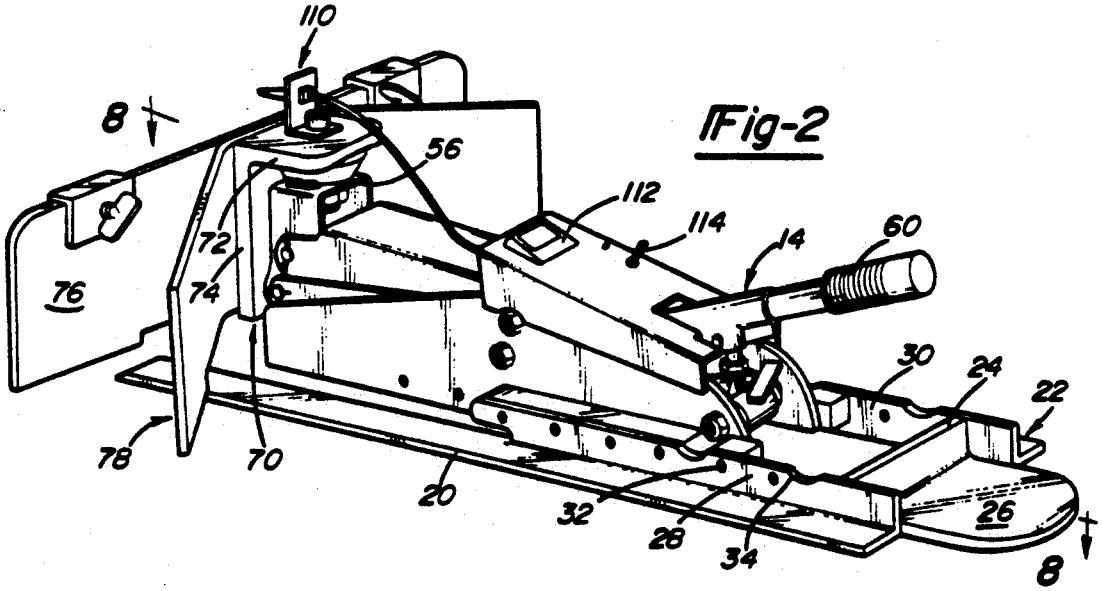
FIG. 2 is a rear side perspective view of the tool of FIG. 1.

Turning to the Figures, particularly FIGS. 1 and 2, a floor covering tool is illustrated and designated with the reference numeral 10. The tool 10 includes a frame 12, a raising and lowering mechanism 14 and a lifting assembly 16. Also, a live current indicator 18, which determines if live current is flowing in the object to be lifted, is associated with the tool 10.

The frame 12 is ordinarily U shaped, including a pair of legs 20 and 22 interconnected by a web 24. Ordinarily, the web 24 includes a foot plate 26 which enhances sliding of the frame 12 along a surface or the like. The lugs 20 and 22 are mirror images of one another. Generally, the legs have flanges 28 and 30 with a plurality of apertures 32. Also, the flanges 28 and 30 include cut out portions 34. The apertures 32 and cut outs 34 enable multi positioning of the raising and lowering mechanism 14 along the frame 12, as can best be seen in FIG. 7. Also, the legs, 20 and 22, at their free extending ends, include a wedging surface 36 and 38 to enable the frame to be wedged under the object to be lifted. The wedging surfaces 36 and 38 are positioned underneath the object to be lifted, if necessary, to enable the initial raising of the object to be lifted.

The raising and lowering mechanism 14 includes a housing 40 with skirts 42 and a top 44. The skirts 42 include a plurality of spaced threaded apertures 46 which align with the apertures 32 of the frame to receive bolts 48 to secure the raising and lowering mechanism 14 to the frame 12. The housing 40 covers a cylinder 50 which has a piston rod 52 connected to a linkage 54 including a post 56 which is coupled with the lifting mechanism 16. An actuating assembly 58 including handle 60 is actuated by moving the handle in an up and down fashion which, in turn, raises the lifting mechanism 16. A thumb screw 62 is turned one way to enable the actuating mechanism 60 to raise the lifting mechanism and is turned in the opposite direction to release the fluid in the cylinder so that the lifting mechanism returns to its original position. This mechanism functions similar to that of a fluid jack system.

The lifting mechanism 16 includes a first member 70 secured to the post 56. The first member 70 generally has an overall L shape. The L is inverted with the horizontal leg 72 secured to the post 56 while the vertical leg 74 is secured to abutment members 76 and 78. Abutment member 76 has an overall rectangular planar shape and is removably secured to the first member 70. Abutment member 76 has its abutment surface substantially in a single plane. Abutment member 78 has an overall elongated V shape having a pair of legs 80 and 82 separated by a planar web 84. The web 84 enables the abutment member 78 to be secured to the leg 74 of the first member 70 as best seen in FIG. 5. The web section 84 is substantially rectangular and planar. Likewise, the legs 80 and 82 have an overall rectangular shape and are likewise planar. The legs 80 and 82 are in intersecting planes and the legs 80 and 82, and web 84 are in different planes. The design of the abutment member 78 enables lifting of partitions or the like at their corners as illustrated in FIG. 4.

Lifting brackets 90 are removably secured onto the abutment members 76 and 78. The lifting brackets 90 have an overall L shape as seen in FIG. 6. The horizontal leg 92 of the bracket may be manufactured in varying lengths from two inches to sixteen inches. Likewise, the free end of the leg 92 may have a wedge member 94. The end of the second leg 96 not connected to the first leg 92, has a downturned flange 98 enabling the bracket to be positioned onto the abutment members. A threaded aperture 100 is located in the flange 98 to receive a thumb screw 102 to retain the bracket in position on the abutment members. The bracket 90 may be multi positioned along the abutment members. Likewise, a plurality of brackets may be positioned onto the abutment members. Also, the bracket members 90 may be moved from abutment member to abutment member.

The live current indicating mechanism 18 generally includes a sensing element 110 and a read out member 112. The current indicating mechanism 18 is generally battery operated. A switch 114 is moved from an off position to an on position to activate the mechanism 18. The sensor 110 is mounted by a bracket 116 onto the first member 70. The read out member 112 is generally mounted on the top 44 of the housing 40. When the current indicator is activated and the sensor 110 senses current in the object being lifted, the read out member 112 indicates voltage exists so that the installer is aware of the voltage in the lifted object.

Figure 3:
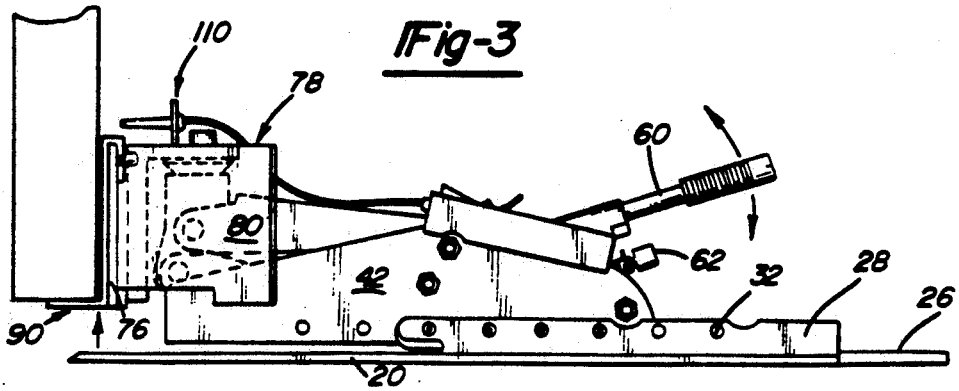

In lifting the object to be lifted, which may be furniture, partitions or the like, the brackets 90 and/or frame wedges 36 and 38 and a portion of the legs 20 and 22 are slid underneath the object to be lifted as seen in FIGS. 3 and 4. The frame leg ends remain positioned underneath the object. The activation mechanism 58 is actuated, via up and down movement of the handle 60, as indicated in FIGS. 3 and 4, to raise the lifting assembly 16. The lifting assembly 16 raises the object to be lifted to a desired height. At that time, flooring or the like would be positioned underneath the object being lifted. After the flooring has been positioned underneath the lifted object, the thumb screw 62 is turned to enable the lifting mechanism to return to its original position. Also, the abutment member 76 may be removed from the lifting mechanism so that the corner abutment member 78 may be used to raise a partition or the like as illustrated in FIG. 4. The above would be followed to raise and lower the corner partition like that illustrated in FIG. 4.

The abutment members 76 and 78 are easily removed from the first member 70 to provide the tool with a convertible lifting mechanism. The single plane abutment member 76 may be used along the sides of the furniture, partitions or the like, while the corner abutment member 78 is used in corner applications. Thus, a single machine may be utilized to lift a corner partition.

While the above detailed description describes the preferred embodiment of the present invention, the invention is susceptible to modification, variation, and alteration without deviating f rom the scope and fair meaning of the subjoined claims.

What is claimed is:

1. A method for lifting furniture partitions or the like comprising:

providing a convertible lifting mechanism including means for raising and lowering a lifting member, said raising and lowering means coupled with a frame and lifting assembly;

connecting means coupled with said raising and lowering means, said connecting means having a planar connecting surface, said convertible lifting mechanism including a first removable member having an abutment contact surface in a single plane for raising and lowering an object to be lifted, said first member having a first connecting portion in said single plane for connecting with said planar connecting surface, a second member having an abutment contact surface for raising and lowering the object to be lifted, said second member having a second connecting portion in a plane parallel to said single plane and connecting with aid planar connecting surface, said second connecting portion being at an angle to said second member abutment contact surface, and said lifting assembly connectable to either of said first or second members for lifting said object, wherein said first member is removed to convert said tool from a first to a second lifting tool;

positioning said lifting mechanism with respect to an object to be lifted such that either said first or second member is in contact with said object to be lifted;

actuating said raising and lowering means to raise said object to be lifted;

actuating said raising and lowering means to return said object to be lifted to its original position.

2. The method according to claim 1 further comprising positioning a portion of said frame under said object to be lifted.

3. The method according to claim 1 further comprising holding said object to be lifted for a desired period of time to install floor covering under said lifted object.

4. The method according to claim 1 further comprising testing for live current in said lifted object via a current indicating means associated with said lifting member.

5. A method for lifting furniture partitions or the like comprising:

providing a lifting mechanism including means for raising and lowering a lifting member, said raising and lowering means coupled with a frame and lifting assembly;

said lifting assembly including a first member coupled with said raising and lowering means, a second member removably coupled with said first member and providing an abutment surface, and a third member releasably coupled with said second member, said third member providing a lifting surface, and said third member being movable with respect to said second member for providing a plurality of lifting positions;

positioning said lifting mechanism with respect to an object to be lifted such that said third member is in contact with said object to be lifted;

actuating said raising and lowering means to raise said object to be lifted;

actuating said raising and lowering means to return said object to be lifted to its original position; and testing for live current in said lifted object via a current indicating means associated with said lifting member.

* * * * *

US005299779B1

REEXAMINATION CERTIFICATE (3607th)

United States Patent [19] [11] B1 5,299,779

Collins [45] Certificate Issued Aug. 18, 1998

[54] FLOOR COVERING INSTALLATION METHOD

[76] Inventor: Harvey C. Collins, 7143 S. River Rd., Marine City, Mich. 48039

Reexamination Request:
No. 90/004,902, Jan. 23, 1998

Reexamination Certificate for:

| | |
|---|---|
| Patent No.: | **5,299,779** |
| Issued: | **Apr. 5, 1994** |
| Appl. No.: | **24,632** |
| Filed: | **Mar. 1, 1993** |

[51] Int. Cl.[6] ..... B66F 3/00
[52] U.S. Cl. ..... 254/1; 254/1; 254/DIG. 4
[58] Field of Search ..... 254/1, 2 R, 8 B, 254/8 C, 133 R, 134, 129, 131, DIG. 1, DIG. 4

[56] References Cited

U.S. PATENT DOCUMENTS

| | | | |
|---|---|---|---|
| 66,170 | 6/1867 | Patterson . | |
| 829,344 | 8/1906 | Larsen . | |
| 2,377,034 | 5/1945 | Pierce . | |
| 2,469,670 | 5/1949 | Thompson . | |
| 2,536,550 | 1/1951 | Hughes | 254/133 |
| 2,786,649 | 3/1957 | Bottorff . | |
| 2,786,650 | 3/1957 | Bottorff . | |
| 2,910,270 | 10/1959 | Schultz . | |
| 2,973,184 | 2/1961 | Trautman et al. . | |
| 3,081,066 | 3/1963 | Murawski . | |
| 3,426,752 | 2/1969 | Laico . | |
| 3,662,994 | 5/1972 | Johns . | |
| 4,070,624 | 1/1978 | Taylor . | |
| 4,194,726 | 3/1980 | Hance | 254/133 R |
| 4,712,771 | 12/1987 | Donnelly et al. | 254/131 |
| 4,846,443 | 7/1989 | Collins et al. | 254/133 R |

FOREIGN PATENT DOCUMENTS

| | | |
|---|---|---|
| 2060557 | 5/1981 | United Kingdom . |

*Primary Examiner*—Robert C. Watson

[57] ABSTRACT

A floor covering installation tool for raising and lowering furniture, partitions or the like has a frame, a raising and lowering mechanism and a lifting assembly. The frame or the lifting assembly has a portion which is positioned underneath the object to be lifted. The raising and lowering mechanism is actuated to raise or lower the object to be lifted. Upon raising the lifted object to a desired height, flooring or the like is positioned underneath the lifted object. After the flooring is positioned underneath the lifted object, the raising and lowering mechanism is activated to release the lifting mechanism and return it to its original position. Thus, the tool is ready to be reused to lift another desired object.

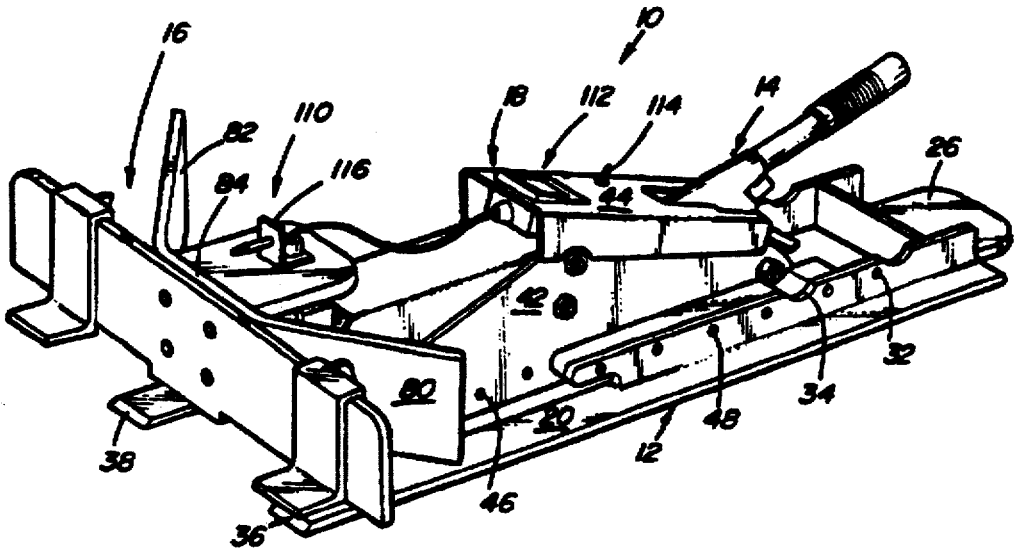

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–5 is confirmed.

* * * * *